United States Patent [19]

Lovell

[11] Patent Number: 4,680,918

[45] Date of Patent: Jul. 21, 1987

[54] PACKAGING WITH COHESIVE COATED MATERIALS

[76] Inventor: Robert C. Lovell, 725 N. Glendale Ave., Glendale, Calif. 91206

[21] Appl. No.: 872,201

[22] Filed: Jun. 6, 1986

[51] Int. Cl.[4] ..... B65B 11/48

[52] U.S. Cl. ..... 53/466; 53/219; 53/390

[58] Field of Search ..... 53/463, 466, 219, 390

[56] References Cited

U.S. PATENT DOCUMENTS

| | | | |
|---|---|---|---|
| 2,725,699 | 12/1955 | Rumsey, Jr. | 53/219 |
| 2,819,574 | 1/1958 | Maust | 53/390 X |
| 3,016,673 | 1/1963 | Parker | 53/390 |
| 3,412,527 | 11/1968 | Aquarius | 53/390 |
| 4,257,212 | 3/1981 | Havens | 53/219 X |

FOREIGN PATENT DOCUMENTS

| | | | |
|---|---|---|---|
| 1261276 | 4/1961 | France | 53/390 |

*Primary Examiner*—John Sipos

*Attorney, Agent, or Firm*—Wm. Jacquet Gribble

[57] ABSTRACT

Apparatus and method for folding cohesive coated material like corrugated paper and coated film about three dimensional solids like paper products, toys, machinery and books for transport is accomplished by a framework supporting a roll or other supply of the cohesive coated material, a guide for the material, a platform for a cutting blade and an end frame or mandrel and a movable U-shaped crimping frame for forcing the leading sheet of coated paper or film back into contact with itself around the object to be packaged.

The apparatus may support horizontally a roll or other supply of cohesive coated paper or film that is conducted over a horizontal shelf beneath a restraining strip and then passed over a rounded mandrel until a proper length is beyond the mandrel so as to encompass the object to be wrapped or packaged, the paper being pulled over the mandrel by contact with a crimping frame of rounded tubing that is articulate with respect to the mandrel. Then the crimping frame is reversed in motion and the paper or film is returned to a vertical position in contact with the object and is then forced about the mandrel by the crimping frame to adhere to itself on three sides of the object and be cut from the roll end when crimping is complete. The crimping of the material is very important to good packaging, but contact pressure alone is sufficient to seal the package and may be accomplished by either the preferred cylindrical tubing or by angle or square tubing.

4 Claims, 9 Drawing Figures

11
17
14
36
43
47
53
33
31
39
42
46
22
40
41
45
28
27
12
37
34
53
15
32
48
18
40A
38
44

40
40A
39
42
43
41
38
37
44
28A
32
12
22
28
34
20
45
46
27
25
A
26
48
53
18
52
B
45
11
15

PACKAGING WITH COHESIVE COATED MATERIALS

BACKGROUND OF THE INVENTION

The invention relates to the field of packaging and more particularly to the packaging three dimensional objects manually in cohesive material such as paper or film that has been coated with a rubber-based substance that adheres to itself and not to the object being wrapped or packaged. Particularly the invention concerns itself to a manual method and apparatus for achieving such packaging with the commercial materials available in today's market and simple mechanisms that supplement the manual dexterity of workers. One or more items may be packaged efficiently by use of the invention without dependence upon other powered devices. On the other hand, multiplied packages may be produced by one person skilled in the method of the apparatus.

The apparatus provides a needed small production capability for those places where output demand varies or is not high but requires simple, precise performance.

SUMMARY OF THE INVENTION

The invention contemplates a framework apparatus for manually packaging objects in cohesive material that comprises a frame capable of resting on a horizontal surface or suspension from a vertical surface, frame having a reel for supporting a roll or other supply of cohesive material, a raised platform above the reel surmounted by a biased guide to bear against paper or other cohesive material as it passes over the raised platform, an upright U-shaped mandrel fixed across the path of the cohesive material and a cutting device for the material disposed between the platform edge and the mandrel. A U-shaped crimping frame surrounding three sides of the upright, fixed mandrel and movable with respect to the mandrel to swing away and toward said mandrel, acts as a movable manual guide against which the advancing edge of the cohesive material is held as the crimping frame is extended beyond the mandrel and then is swung back toward the mandrel to form a material receptacle for the object being packaged. The crimping frame overlaps the upright mandrel as the frame returns to upright with the cohesive material around the object and engages the material crimping it between the fixed mandrel exterior surfaces and the crimping frame interior surfaces on three sides. The cutting blade is usable at this point to sever the package portion from the material web.

The method of the invention includes the steps of extending the cohesive material from its roll to beyond the upright mandrel by means of the crimping frame, placing the object to be packaged against the extended material, folding the material about the object to be packed by returning the crimping frame to upright position, then crimping the edge of the material around the object by passing the crimping frame across the upright mandrel and then severing the filled cohesive material from the roll end.

The apparatus is preferably made from a framework of round tubing to which the material reel, platform and cutting device are mounted. The latter may be any commercial track and blade, but the Bulman Rotary Shear has proved to be effective. The spacing between the upright mandrel and the crimping frame varies with the thickness of the cohesive paper or film used and the washers between the mandrel and the pivot points may be changed with respect to the frame to vary the gap between frame and mandrel.

Apparatus is thus formed that is inexpensive to fabricate, easy to comprehend and readily operated manually. Materials are all commercially obtainable. These and other advantages of the inventive apparatus and method are apparent from the following detailed description and drawing.

DETAILED DESCRIPTION OF THE DRAWING

In the various Figures like parts are referred to by like numbers.

DESCRIPTION OF THE PREFERRED EMBODIMENTS

Figure 1:
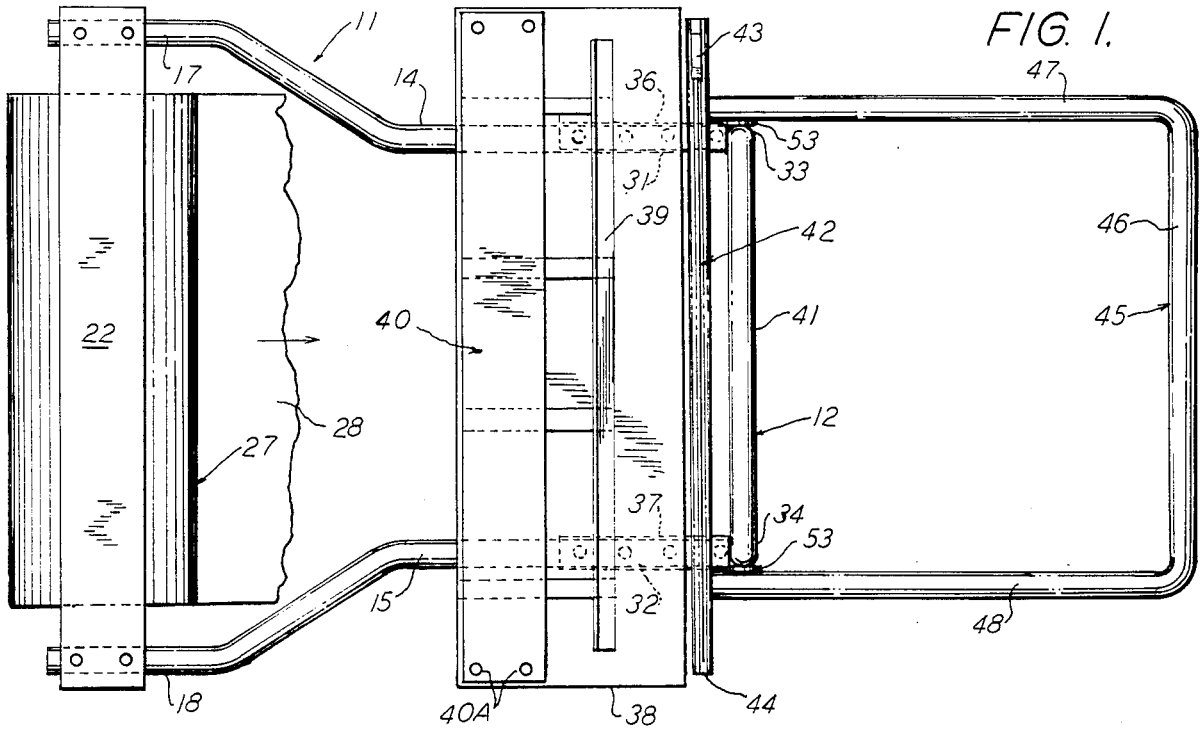
FIG. 1 is a top plan view to a reduced scale of the apparatus of the invention, with the material from the supply roll broken away.
Figure 2:
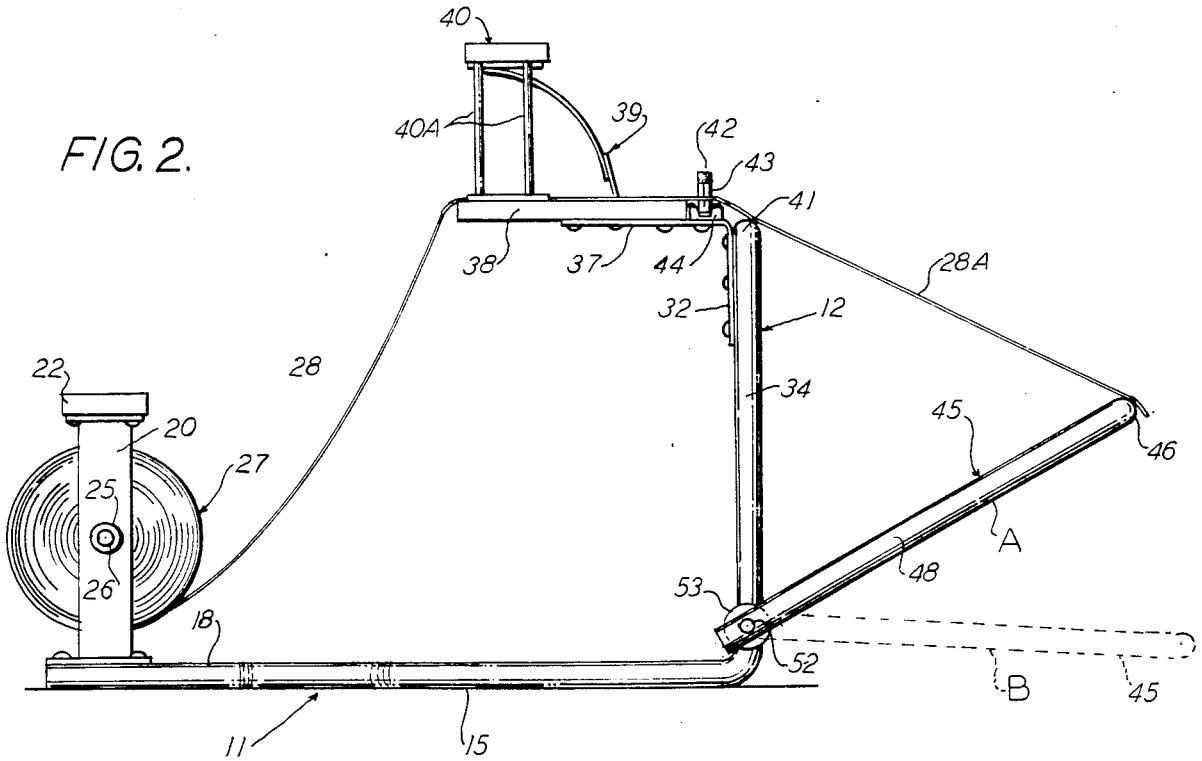
FIG. 2 is a front elevational view of the apparatus of FIG. 1.
Figure 3:
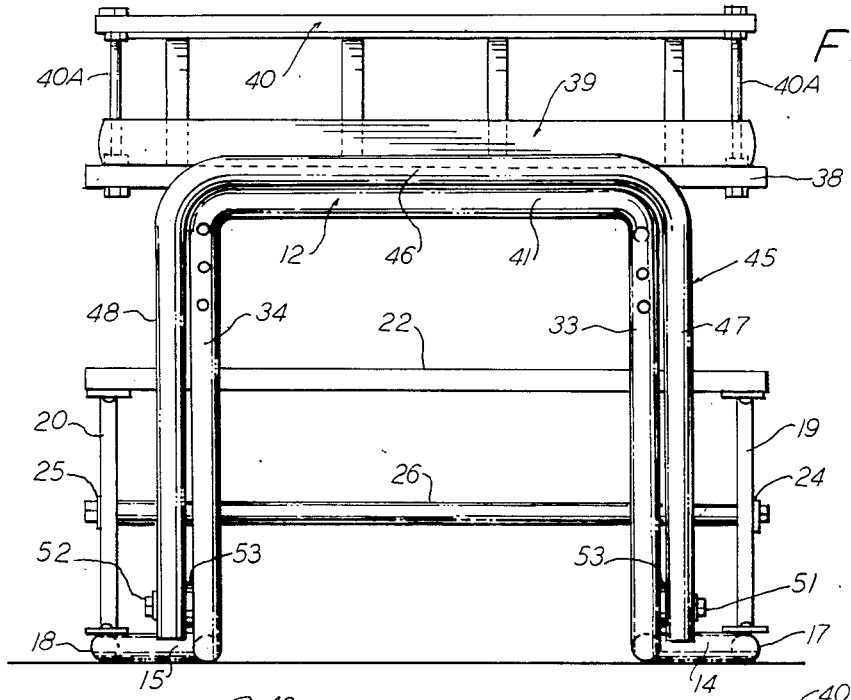
FIG. 3 is a right end elevational view of the apparatus of FIG. 1 with the cohesive paper roll removed.

FIGS. 1, 2 and 3 show the apparatus to have a framework 11 comprised of an upright tubular mandrel 12 with rearwardly extending tubular rests 14, 15. Each rest extends normal to mandrel 12 for most of the rearward run and then diverges outwardly in the horizontal plane to terminate in spaced ends 17, 18. Spaced vertical columns 19, 20 are fixed to the ends, spaced apart at the top by a transverse strut 22. The two columns hold middle journals 24, 25 that receive the ends of a supply shaft 26 for a roll 27 of cohesive paper 28 that may be corrugated.

Transversely spaced brackets 31, 32, fastened to vertical spaced legs 33, 34 of mandrel 12 by suitable fasteners, have bracket legs 36, 37 that extend horizontally from the mandrel toward the rear of the framework and support a transverse platform 38 that in turn holds a higher, biased, guide wiper 39 extending transversely across the upper surface of platform 38 parallel to upper tube 41 of the mandrel. Each end of a guide base 40 rests upon vertical pairs of bolts 40A.

Between upper tube 41 and the forward edge of the platform is a cutoff device like that made by Bulman Products Division of ROSPATCH Corporation of Grand Rapids, Mich. The cuttoff 42, like other devices comprised of a rotary cutter blade like blade 43 and an elongate horizontal guide like grooved guide 44, will work as well.

A crimping frame 45 of U-shape configuration, comprising a top bar 46 and depending limbs 47, 48 is pivotably engaged with the mandrel 12. The frame preferably is made from tubing and the pivots 51, 52 attach the frame to the mandrel near the mandrel bottom at each mandrel leg 33, 34 so that the crimping frame may swing away from and toward the mandrel about pivots 51, 52. Spacers, that may be properly chosen washers 53, set the gap between the tubular mandrel exterior and the like tubular crimping frame interior. Since the cohesive material being used may vary with the object being packaged, pivots 51, 52 are preferably demountable so that the spacers may be changed to fit the package material used.

It may be desirable to vary framework 11 in order to adapt to objects and cohesive materials of varying width and depth. Widths from 12 to 36 inches, in increments of 6 inches, are presently contemplated. A smaller width of 9 inches is also used in some volume. With each different cohesive material width of 6 inches a different mandrel and crimping frame are required. It is possible to adjust for small differences by splitting the upper tubes 41 and 46 of mandrel and crimping frame and supplying an adjustable sleeve joint, but it is preferred at this time to provide separate frameworks for each cohesive material width.

Figure 4:
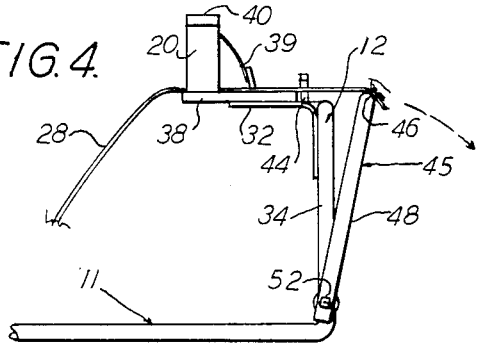
FIGS. 4 through 9 are schematic fragmentary views further reduced in scale, of the apparatus of FIG. 2, showing successively the steps of the process of the invention.
Figure 5:
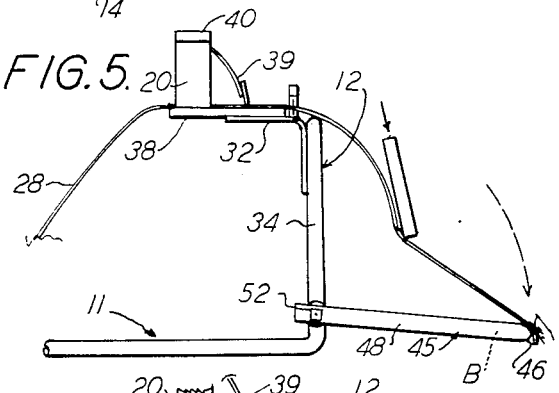

FIGS. 4 through 9 illustrate a process by which packages are fabricated using the apparatus of FIGS. 1–3 with a roll 27 of cohesive corrugated paper 28 on the supply reel shaft 26 of FIG. 1. In FIG. 4 the web of paper 28 passes over platform 38 and beneath biased guide wiper 39. The paper also passes over rotary cutter guide 44 and is held to crimping frame 45 by the operator's digit. The frame is drawn away from the mandrel by the operator while still holding the cohesive paper to the frame, thus drawing the paper across the platform 38 and from the supply roll 27. The frame is still drawn from the mandrel with the paper as shown in FIG. 5 until the bight of paper between the mandrel and the frame is sufficient to encompass the object to be packaged on both sides and leave enough edge paper to afford crimping around the mandrel when the crimping frame is returned to upright position. However, before returning, the object is put into the bight of paper 28 as shown in FIG. 5, to start the wrap about the object being packaged.

Figure 6:
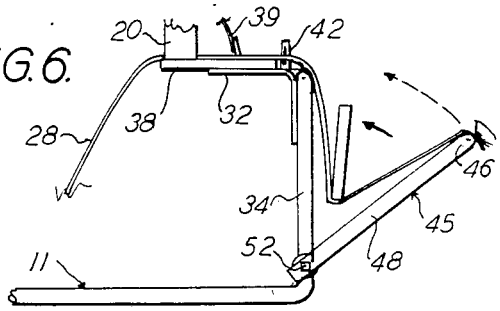
Figure 7:
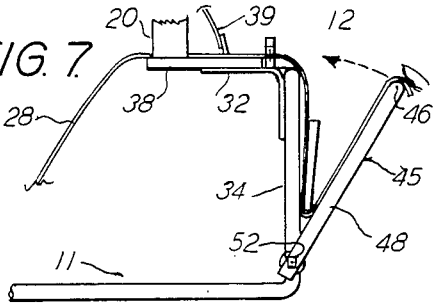
Figure 8:
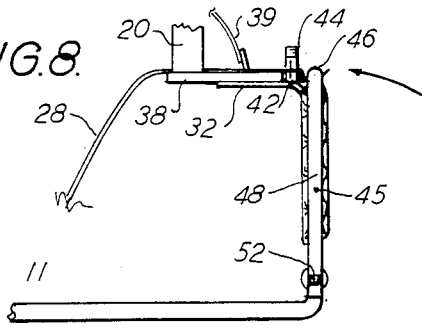
Figure 9:
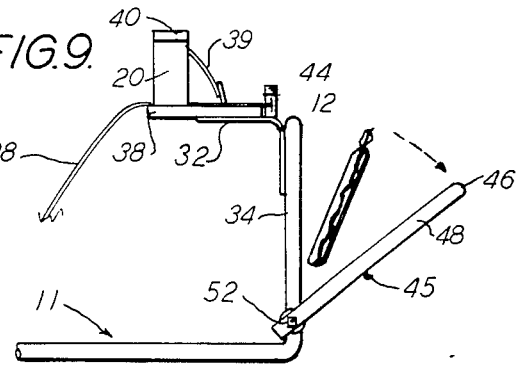

In FIG. 6 the direction of crimping frame motion is reversed, forming more of a pocket of the cohesive paper around the object as the frame 45 approaches the upright attitude of the mandrel. The pocket is shown nearly closed in FIG. 7, since the cohesive paper has been firmly held to the frame through all of the operation. In FIG. 8 the paper is finally released by the operator as the crimping frame is manually forced around the mandrel with the cohesive paper crimped between mandrel and frame on three sides other than the folded side. The paper is pressure crimped by the association of the mandrel exterior sides and the interior surfaces of the crimping frame. Firm pressure is applied to the frame by the operator to accomplish the crimping.

The spacing of the frame pivot points from the top of the mandrel and the width of the gap around the mandrel to the frame are important and determine in part how well the cohesive material joins to itself, since the gap and the two thicknesses of cohesive material set the pressure applied to the material and the success of the crimping bond. Another factor is the "tackiness" of the coating, determined at the source of the cohesive material.

In FIG. 8 the crimping step is shown as the crimping frame is pressed manually about the mandrel in the only step of the process where the operator does not hold the cohesive paper to the crimping frame. Since so little paper protrudes beyond the crimped area of the edge, the operator may manipulate cutter 42 across cutter guide 44 and sever the now completed package from the paper web. The cut leaves sufficient paper to enable the operator to grasp the end to apply it to the crimping frame for the next operation.

Terms such as "upright" and "rearwardly" and other directional words are to be taken relative to the apparatus as shown in FIG. 2, since the device is capable of use in more than one orientation. The apparatus, for instance, may be mounted to a vertical surface instead of to a horizontal one and operate with equal facility. The framework may be of square tubing or of angle, as well as of the illustrative cylindrical tubing. Other modifications within the scope of the invention may occur to those skilled in this particular art. Therefore it is desired that the invention be measured by the appended claims rather than by the illustrative matter contained in the specification.

I claim:

1. A process for folding cohesive sheet material about an object to form a sealed package using a framework with a material supply reel and a mandrel and a crimp frame pivotably movable with respect to said mandrel, and a paper cutoff movable transversely of mandrel, including the steps of loading the reel with cohesive material in roll form, threading said material over a platform and the mandrel to contact with an upraised crimp frame, securing the advance edge of the material to the top bar of the crimp frame manually, pivoting the crimp frame away from the mandrel sufficiently to define a material sleeve for both obverse and reverse sides of the object being packaged, depositing the object against the material near the middle of the material web formed by extending the frame from the mandrel with the material edge still held manually to the frame, returning the loaded crimp frame with the material edge still held manually to an upright postition adjacent the cohesive material-draped mandrel to contact both sides of the object with material, pressing the crimp frame past the mandrel to compress the material between the mandrel and the frame and bond the two folded edges of the material together at two sides and an end, and then manipulate the cutter transversely to sever the package thus formed from the material supply.

2. Apparatus for folding cohesive sheet material about an object to form a sealed package and comprising a framework, a material supply reel associated with said framework, a material mandrel remote from the reel and in the path of material feed, framework rests extending from the mandrel and supporting said supply reel, a raised platform supported from said mandrel, a movable paper cutter mounted adjacent said mandrel, a paper restraint mounted adjacent said raised platform transverse to said material path and behind said cutter, a crimp frame adjacent on three sides to said mandrel, said crimp frame being pivoted at the bottom of said mandrel for motion of the crimp frame away from and toward said mandrel to surround said mandrel, said paper cutter being movable across said material path adjacent said mandrel.

3. Apparatus for folding cohesive sheet material about an object to form a sealed package and comprising a framework, a supply reel for said material supported by said framework, an upright U-shaped mandrel remote from said reel and in the path of material feed, framework rests extending from the bottom of said mandrel rearwardly and supporting said supply reel, a raised platform supported from said mandrel at the top of said mandrel, a movable paper cutter mounted transversely of said material path adjacent said raised platform, a paper restraint mounted adjacent said raised platform transeverse to said paper path and behind said cutter, a U-shaped crimp frame adjacent on three sides to said mandrel, said crimp frame being pivoted at the bottom of said mandrel for motion of the crimp frame away from and toward said mandrel to surround said mandrel, said paper cutter being rotary and movable in a guide across said paper path adjacent of the mandrel.

4. Apparatus in accordance with claim 3 wherein each of said mandrel and said crimp frame are of U-shaped cylindrical tubing.

* * * * *